US011745074B1

(12) United States Patent
Whitelockecrawford

(10) Patent No.: US 11,745,074 B1
(45) Date of Patent: Sep. 5, 2023

(54) GOLF SWING TRAINING AID

(71) Applicant: Raymond H. Whitelockecrawford, Wickenburg, AZ (US)

(72) Inventor: Raymond H. Whitelockecrawford, Wickenburg, AZ (US)

( * ) Notice: Subject to any disclaimer, the term of this patent is extended or adjusted under 35 U.S.C. 154(b) by 0 days.

(21) Appl. No.: 17/855,148

(22) Filed: Jun. 30, 2022

(51) Int. Cl.
*A63B 69/36* (2006.01)

(52) U.S. Cl.
CPC ..... *A63B 69/3608* (2013.01); *A63B 69/3621* (2020.08)

(58) Field of Classification Search
CPC ..... A63B 69/3608; A63B 69/3621
USPC ..... 473/138, 139, 212, 214, 217, 270, 273, 473/275–277, 425, 458, 464, 518
See application file for complete search history.

(56) References Cited

U.S. PATENT DOCUMENTS 2,498,006 A * 2/1950 Ridill ..... A63B 21/4021 482/125
5,303,927 A * 4/1994 Perry ..... A63B 69/0059 473/215
5,340,110 A * 8/1994 Mollis ..... A63B 69/0059 473/217
5,628,695 A * 5/1997 Worthington .... A63B 69/36212 473/258
6,224,522 B1 5/2001 Ervin
7,731,597 B1 6/2010 Burgess
8,500,569 B2 8/2013 Moore
10,610,756 B2 * 4/2020 McGrail ..... A63B 69/3608
2001/0031684 A1 10/2001 Ervin
2005/0159232 A1 * 7/2005 Mackay ..... A63B 21/0552 473/219

FOREIGN PATENT DOCUMENTS

KR 100977320 B1 8/2010

* cited by examiner

*Primary Examiner* — Nini F Legesse
(74) *Attorney, Agent, or Firm* — Bycer & Marion, PLC; Matthew L. Bycer; Michael B. Marion

(57) ABSTRACT

A golf swing training aid comprises a set of components which include a substantially cylindrical grip bar with a first larger end tapering to a second smaller end so as to resemble the grip portion of a golf club. The grip bar has a first attachment eye at its first end. An extendable tensile member with first and second attachment affordances at its ends, such as clips or formed wire hooks, is attached to the first attachment eye at one end and a second attachment eye at the other end. A foot band attachment bracket has a second attachment eye and a base plane which is stepped upon for stability while a user exercises or practices golf swings while working against tensile resistance developed in the tensile member. The attachment component may be formed of sheet metal or made of formed metal wire in whole or in part.

18 Claims, 8 Drawing Sheets

GOLF SWING TRAINING AID

FIELD

The invention relates to tools and aids for training posture and motion during a golf swing, and more particularly to improved control over golf swing motion in the takeaway motion.

BACKGROUND

The inventor is a student of the game with over twenty years of experience in playing, coaching, and studying the human mechanics associated with the golf swing. The inventor's background as an educator, coach, and adult student of the game has allowed for the ability to witness firsthand the potential benefits that may be derived from actual usage of the device and the education and training required to effectuate its use. However, the inventor has also witnessed the problems that may occur when students of the game believe that the information they are gaining in the classroom setting is largely theoretical in nature as opposed to being practical knowledge that may be used in real-world settings for the benefit of themselves and their overall golf experience and performance.

A golfer's skill level may be greatly enhanced with proper education and training. Golfers need to obtain the requisite physical and mechanical feedback associated with the intended mechanics in order to have a positive impact on their overall performance. However, the form of education and training that many golfers receive is less than effective because the focus of the education is not on the mechanical feedback associated with practical knowledge or demonstration. Furthermore, there is a lack of recognition that many golfers may already possess knowledge from prior experiences and activities, such as from playing baseball or tennis, that may be used as a basis for providing additional education and knowledge.

A golfer, regardless of experience level, requires some form of training and education to support the maturity and sustainment of his or her golf swing. Extended time away from swinging the golf club may lead to poor swing habits such as inconsistent swinging of the club or poor body posture at address to the golf ball. Confusion and frustration often set in when the golfer is unable to receive certain physical feedback that could heighten the awareness of what's going on during the club swing process, be it body posture, arms and shoulder movement, or a combination thereof.

Furthermore, the changing landscape around the instruction of the golf swing may be hard to digest. Many golfers often rely on their thoughts while executing the intended action versus the sensing of their body mechanics. This "thinking while doing" often leaves the golfer in a paralyzed state, having either fixated, omitted, or misinterpreted the fundamentals necessary for executing the desired tasks of swinging the golf club.

Unfortunately, a disconnect seems to exist between the golfer's ability to learn and the ability to execute or demonstrate the learned information. Part of this disconnect seems to be based on a lack of understanding about the potential benefits of sensing the motion during various phases of the golf swing.

Thus, opportunities exist to provide better tools and methods for golfers to receive instructions that are based on their own needs and motivations as well as practical application and respect for their experience and knowledge.

BRIEF DESCRIPTION

A primary objective of the invention is to provide a learning and practice aid that viscerally informs the golfer about current versus preferred motions of the club and the golfer's body during various important portions of the swing.

A corollary objective of the invention is to aid the golfer in improving a golf swing transition from address to takeaway of a swing to a downswing portion of the swing, wherein the takeaway portion includes a preferred path.

Another objective of the invention is to provide a learning aid that assists a golfer in becoming aware of and improving rotation of shoulders during the takeaway and/or downswing portion of a swing. A corollary objective of the invention is to provide a learning aid that assists a golfer in becoming aware of and improving the timing mechanics of a swing by means of experiencing resistance during the takeaway portion of the swing.

Yet another objective of the invention is to provide a learning aid that allows for a more compacted swing by preventing the arms from being overstretched.

Another objective of the invention is to provide a learning aid that assists a golfer in becoming aware of and improving shoulder movement isolation during takeaway and/or downswing transition portions of a golf swing.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF PREFERRED EMBODIMENTS

Figure 1:
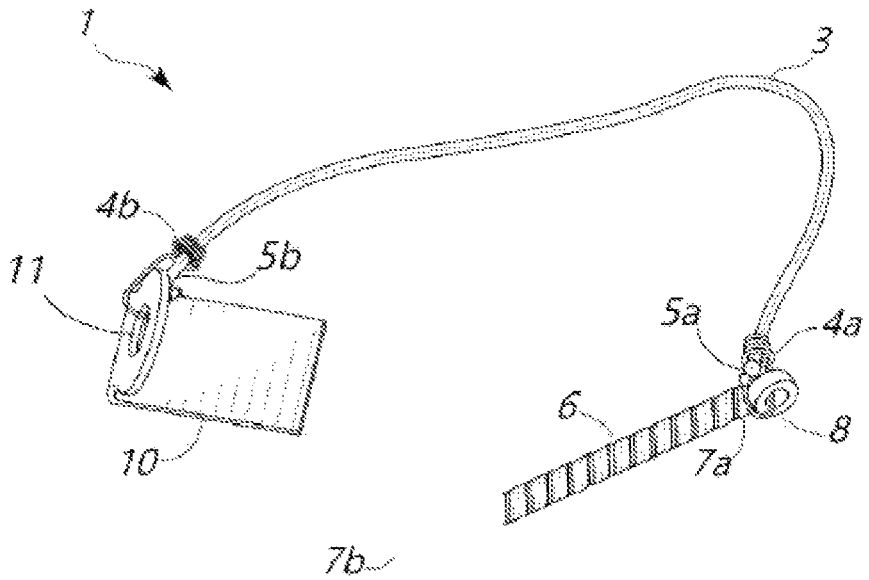
FIG. 1 shows components of a golf swing training aid in accordance with the invention connected together and ready for setup and use.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Also, although particular grammatical genders may be used in this specification, it will be understood that a user, including a golfer or a student of the game of golf, may be of any gender, including usages where male grammatical genders subsume female grammatical genders. Where figures depict a user, any resemblance to actual persons or copyrighted characters is entirely coincidental and irrelevant to the material being disclosed and explained. Also, regardless of appearances as depicted, a user may be of any gender or physique and the specificities of the artworks presented herein are in no way intended to exclude or limit any range or types of persons who may enjoy the benefits of the invention.

A golf swing training aid [1] may be a set of components which may include a substantially cylindrical grip bar [6], an extendable tensile member [3], and a foot band attachment component that may be a bracket [10]. The grip bar [6] may have a first larger end [7*a*] tapering to a second smaller end [7*b*] so as to resemble the grip portion of a golf club. The grip bar [6] may have a first attachment eye [8] at its first end [7*a*]. The extendable tensile member [3] may have a first attachment affordance [4*a*] on a first end [5*a*] and a second attachment affordance [4*b*] at a second end [5*b*]. The attachment affordances may be clips or formed wire hooks or some other attachment mechanism. The tensile member [3] may be a bungee cord. The bracket [10] may have a second attachment eye [11] and a base plane [14] which may be stepped upon for stability of the bracket while a user exercises or practices golf swings while working against tensile resistance developed in the tensile member [3]. The bracket [10] may be formed of sheet metal or made of formed metal wire in whole or in part.

For all figures, reference numerals and reference letters for elements described in any one figure represent the same elements as they appear and are referenced in any other figures, without requiring redundant recitation of the same description in those other figures.

Effective impact of a golf club with a golf ball requires club management as well as controlling club position within the golfer's impact zone. The golf swing training aid [1] is directed to aiding the golfer with timing mechanics via dynamic resistance during the takeaway, transition, and downswing portions of a golf swing by allowing rotation of the shoulders and the fostering of a posture that supports a compacted swing. These activities are an integral part of sustaining a consistent golf swing. The overall purpose of this device is to improve the golfer's sensing mechanics related to shoulder movement isolation during the takeaway, transition, and downswing while allowing for dynamic feedback to assure enhanced tempo and rhythm (timing) prior to striking the ball.

The golf swing training device primarily provides feedback within the takeaway, transition, and downswing portions of a golf swing. Furthermore, the device is primarily intended for training purposes and not meant to be used during the actual or formal gameplay of golf.

Referring to the figures, FIG. 1 shows components of a golf swing training aid [1] in accordance with the invention connected together and ready for setup and use. The invention may be described as an assembly or as a kit of components. A first component may be a substantially cylindrical grip bar [6] with a first larger end [7*a*] tapering to a second smaller end [7*b*] which may have a first attachment eye [8] at the first end [7*a*]. The first attachment eye [8] may be hard molded or a single unitary body with the grip bar [6] or may be a threaded attachment that fits into receiving threads within the grip bar [6]. A preferred size for the first attachment eye [8] may be a loop or hole of about ¾" in diameter. The grip bar [6] may be formed of a telescoping handle. The grip bar [6] may be a true or near true cylinder, however, it may be ergonomically and functionally preferred to taper from the first larger end [7*a*] to the second smaller end [7*b*] to allow for ergonomic grip, as well as control grip with the index finger and thumb to allow for proper rotation of the wrists. As used herein, the term substantially cylindrical refers to a cylinder, either solid or hollow, preferably with ergonomically extending ridges on an exterior side, and may have an arc or cone shape up to twenty degrees, as is known in the art of golf club handles. A second component may be an extendable tensile member [3] with a first attachment affordance [4*a*] and a second attachment affordance [4*b*] at its first end [5*a*] and second end [5*b*], respectively. A preferred material for the tensile member [3] may be bungee cord. A third component may be a foot band attachment component that may be a bracket [10] which may have a second attachment eye [11].

It may also be possible to attach further portions of a golf club, such as a shaft and a club head or weight to an end of the grip bar [6] to simulate a golf club. However, as the invention is directed to training the proper movement, such weight or further modelling of the golf club are not necessary. In addition, there may be an advantage to removing the weight of the golf club shaft and/or head. Emphasis is placed on the golfer establishing a balanced stance and grip; once established, the mechanics of the club take-away, backswing, transition, and downswing by the golfer is paramount. By eliminating the shaft/head, the golfer may now focus on the mechanics via muscular sensing, especially within the hips and shoulders, particularly the lead shoulder (the left shoulder, for right-handed golfers). The golfer may grip with the pinky at the end of the grip bar [6], proximal to the first attachment eye [8], or up to two inches from the first end [7*a*] of the grip bar [6].

Although there are a number of means for appending the first attachment eye [8] to the grip bar [6], a preferred construction may include the grip bar [6] having a threaded aperture at the first larger end [7*a*] and the first attachment eye [8] having a threaded bolt member that fits within the threaded aperture. If the grip bar [6] does not have thick or strong enough sidewalls, the use of a threaded bolt member to append the first attachment eye [8] to the grip bar [6] may cause the grip bar [6] to crumple, crinkle, or deform, leading to a preference for a unitary body. There may also be difficulties with unthreading, and the grip bar [6] and first attachment eye [8] may require a fastener, such as a cotter pin, to eliminate unscrewing of the threaded bolt member when the first attachment eye [8] is exposed to stress or tension at various angles. Given the usual thickness of the walls of the grip bar [6], a high torque pressure that would satisfactorily secure the threaded bolt member would cause deformity to the threaded aperture of the grip bar [6]. When using a golf club shaft with a threaded interior side wall, as the grip bar [6] and threaded bolt member experience rotational force from the tensile member [3] during a takeaway stroke, the threaded bolt member may improperly rotate to resist rotation.

In the assembly shown, the first attachment affordance [4*a*] at the first end [5*a*] of the extendable tensile member [3] may be attached to the first attachment eye [8] of the grip bar [6] and the second attachment affordance [4*b*] at the second end [5*b*] of the extendable tensile member [3] may be attached to the second attachment eye [11]. The tensile member [3] may be doubled upon itself to increase the resistance force for the golfer's exercise.

One method of doubling the exercise force may be to attach both the first attachment affordance [4*a*] and the second attachment affordance [4*b*] of the extendable tensile member [3] to the first attachment eye [8] and pass the extendable tensile member [3] through the second attachment eye [11]. Another method may be to attach the first attachment affordance [4*a*] and the second attachment affordance [4*b*] to the second attachment eye [11] and pass the extendable tensile member through the first attachment eye [8].

An alternative description of the components of the invention may be a convenient and easily portable exercise or practice kit. The golf swing training aid [1] kit may include a practice handle or grip bar [6] with a first larger end [7*a*] tapering to a second smaller end [7*b*] and a first attachment eye [8] at the first end [7*a*], an extendable tensile member [3] having a first attachment affordance [4*a*] and a second attachment affordance [4*b*] at its first end [5*a*] and second end [5*b*], respectively, and a bracket [10].

The grip bar [6] may be a complete golf club or at least a handle or grip portion of a golf club, or a tapered bar sized to approximate an actual golf club grip. Golf club shafts may range between 60 g and 110 g or more. A preferred handle may be fashioned from an 80 g shaft with a medium or a small grip. The top end of the shaft may be designated as the first larger end [7*a*] of the grip bar [6] which would include a threaded aperture to receive the threaded bolt member of the first attachment eye [8].

Figure 2:
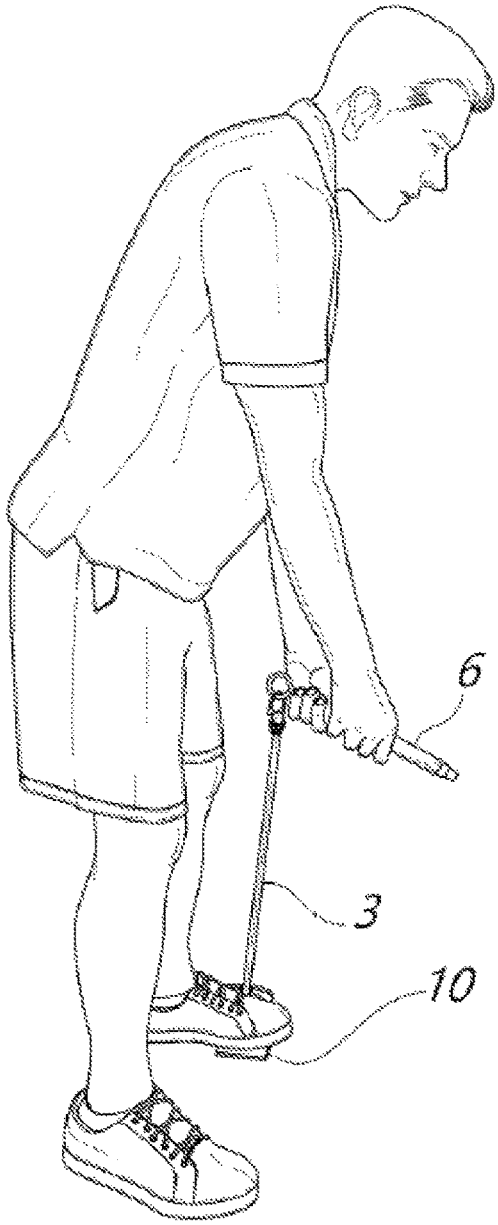
FIG. 2 shows a right-side view of a golfer using the training aid during an "address" portion of a practice golf swing.

FIG. 2 shows a right-side view of a golfer using the training aid [1] during an "address" portion of a practice golf swing. The user may step on the bracket [10] at the base plane [14] and grip the grip bar [6], and the tensile member [3] may be drawn taut to various tensions during the various motions of practice golf swing. A preferred length of the tensile band [3] may preferably be approximately 30-32 inches, and may preferably be a bungee-cord or shock cord-type band as is known in the art. For taller or shorter athletes, the band length may be adjusted. The cord may not be taut at address (when initially holding the grip bar in the down position). Resistance in the band may grow during the takeaway as the first attachment eye [8] is moved further from the second attachment eye [11] on the bracket [10]. A preferred resistance or stiffness of the tensile member [3] may approximately be eight to ten pounds per foot, with zero resistance at address.

The theory for preferred tensile member [3] length may be as follows: (a) A user with long arms will have greater displacement of the tensile member [3] at backswing (before transition to downswing) than that of a user with shorter arms. (b) On average, from top of shoulder to center of palm is 26 to 30.5 inches. Users outside these parameters need to accommodate for any length disparities by using a tensile member [3] of varied length. Eight to ten pounds of resistance allows for the user/golfer to establish and maintain a relaxed grip at address, takeaway, backswing, transition, and downswing. This relaxed posture allows the user/golfer to use their core muscles and hips to load up without body tension.

The grip bar [6] may preferably be gripped as a golfer would grip a golf club during the course of practice or play. When held closer to the second smaller end [7*b*], there may be added torque on the hands to keep the grip bar [6] in the proper orientation. At address, the user's grip hand (for a right-handed user, the grip hand is the left hand) may preferably hang naturally towards his/her feet. When the grip on the grip bar [6] is established, the golfer may unhinge their arms by slightly turning their elbows inwards. If this motion is established, the takeaway process may be achieved with greater ease.

The user/golfer may preferably use their lead shoulder to initiate the takeaway and continue to move the grip bar [6] toward the back of the stance by pushing their hands backward with their shoulders and aided by their hip turn, causing the front knee to bend slightly. The hands should preferably travel backwards until the golfer is loaded with potential energy, otherwise known as 'in stack.' The torque should preferably be felt in the golfer's hips more than in the golfer's hands.

Figure 3:
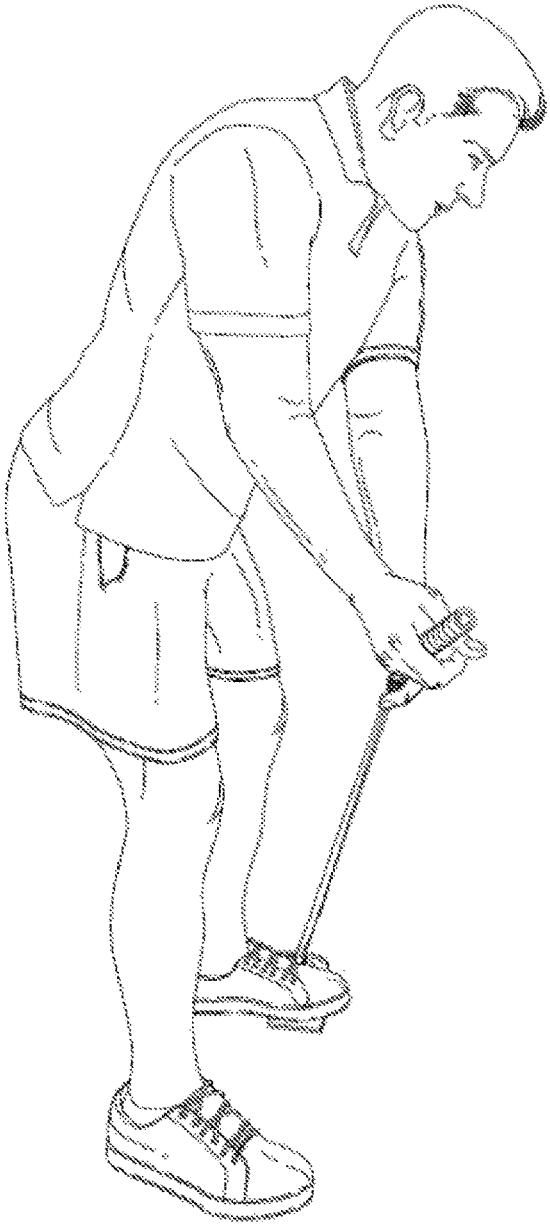
FIG. 3 shows a right-side view of a golfer using the training aid at the midway of a "takeaway" portion of a practice golf swing.

FIG. 3 shows a right-side view of a golfer using the training aid [1] at the midpoint in the "takeaway" portion of a practice golf swing. In this embodiment, the lead shoulder may cause a force to be exerted through a stiff, straight, lead arm to push the grip bar [6] backward, while the second end [5*b*] of the tensile member [3] may be fixed proximal to the lead foot by attachment of the second attachment affordance [4*b*] to the second attachment eye [11] of the bracket [10].

Figure 4:
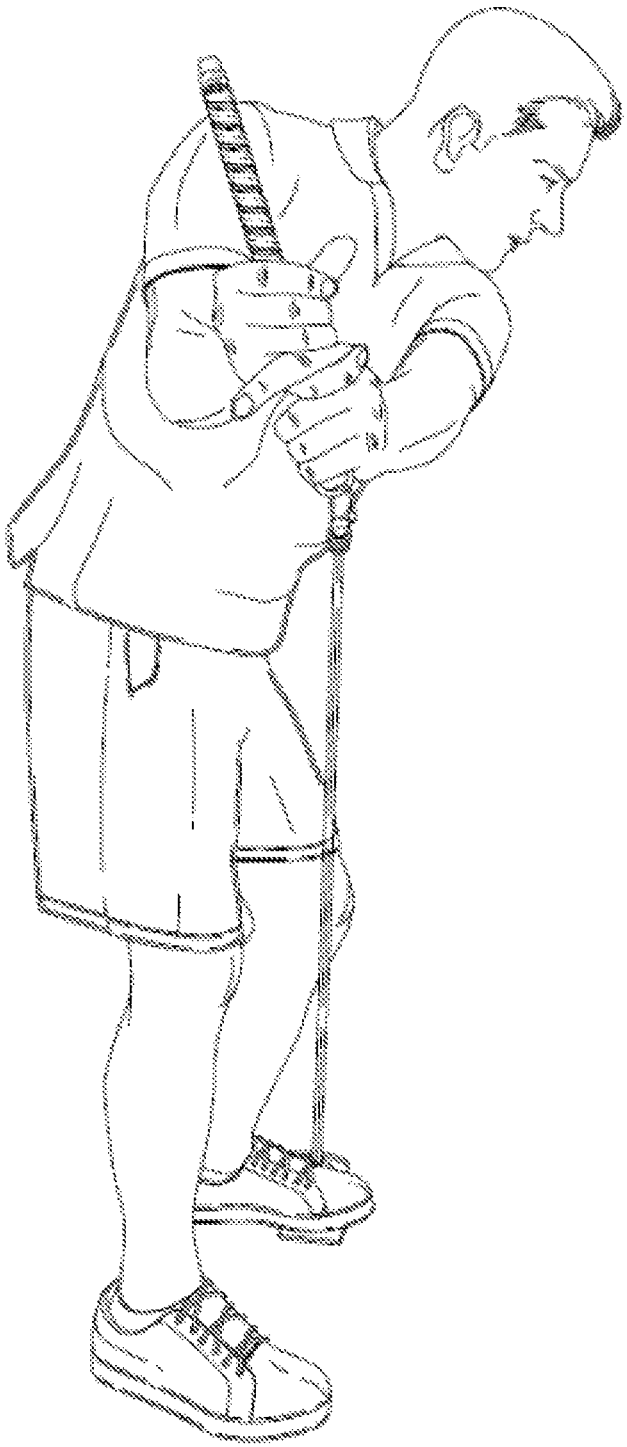
FIG. 4 shows a right-side view of a golfer using the training aid at the end of a "takeaway" portion of a practice golf swing, towards the transitioning to a beginning of a "downswing" portion of the practice golf swing.

FIG. 4 shows a right-side view of a golfer using the training aid [1] at the end of a "takeaway" portion of a practice golf swing, transitioning to a beginning of a "backswing" portion of a practice golf swing. In this embodiment, the grip bar [6] may be raised and the tensile member [3] may be at or near its maximum tension for this exercise. The lead shoulder may force the grip bar [6] backward to the extent to the length of the left arm.

Figure 5:
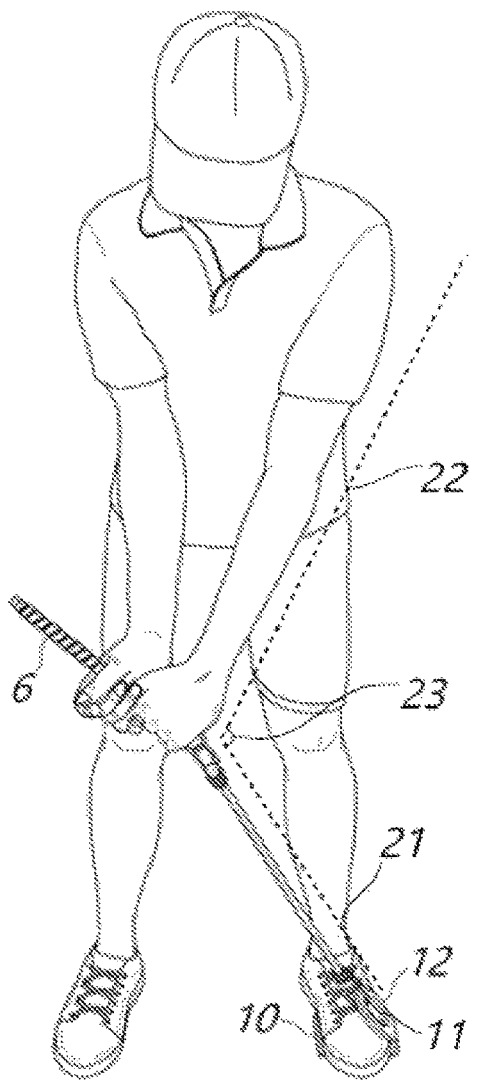
FIG. 5 shows a top front view of a golfer using the training aid at the beginning of a takeaway portion of a practice golf swing.

FIG. 5 shows a top front view of a golfer using the training aid [1] at or near the beginning of a takeaway portion of a practice golf swing. The golfer may step on the bracket [10] to secure it in place during practice swings. The extendable tensile member [3] may be connected at the first attachment eye [8] of the grip bar [6] and at the second attachment eye [11] of the foot band attachment component [10].

While the figures may show various stages of the takeaway, there may be a difference in motion for the through-stroke. Once the shoulder rotation begins the takeaway, the golfer's front knee may bend slightly as the hips are loading. At downswing, the shoulders may transition so that the arms can swing the club. Timing of the load shifting between the back leg and the front leg during the through-stroke may be quicker than during the takeaway. The device may not necessarily be intended to show the full swing (address, takeaway, transition, downswing, and follow-through), but to focus on the takeaway.

A preferred construction may use an 80 g flex shaft such as for a 9-iron with a medium or small grip and with about 7 lbf to 12 lbf of force within the extendable tensile member [3] under various degrees of strain during the practice exercise, where "lbf" is used denotes "pounds force" to differentiate from "pounds mass" ("lbm.") The first end [5*a*] and second end [5*b*] of the tensile member [3] may be attached to the grip bar [6] and bracket [10] with adjustable snap straps to facilitate stabilization with the golfer's lead foot. The inside of a golf club shaft may be threaded to accommodate screwable connection for the first attachment eye [8].

Figure 6:
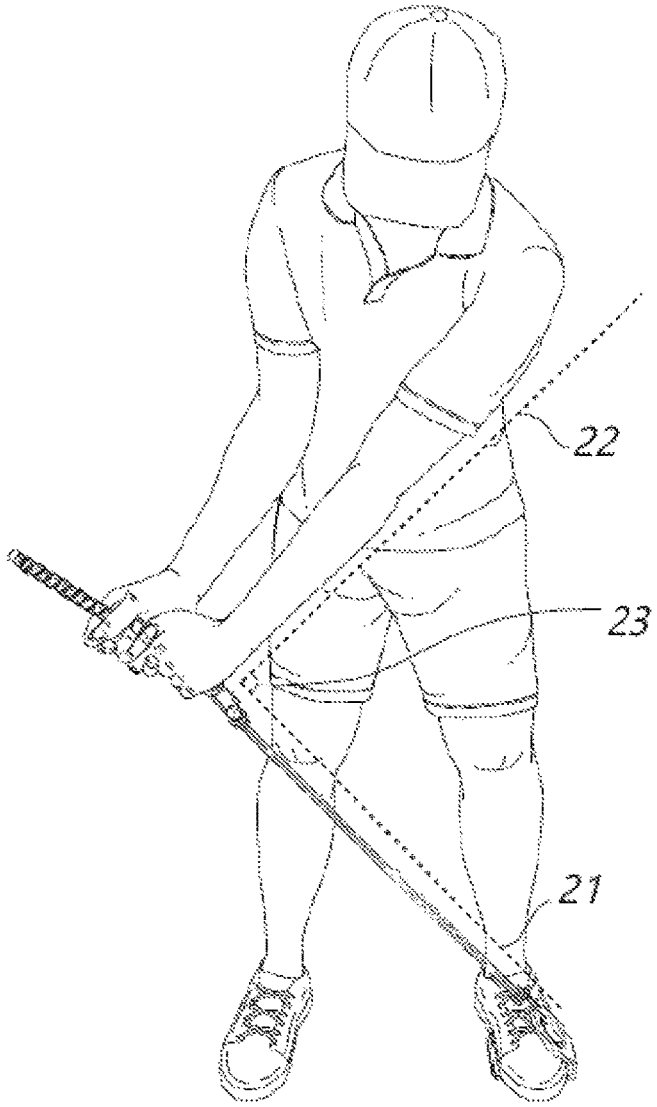
FIG. 6 shows a top front view of a golfer using the training aid at an intermediate midposition of a takeaway portion of a practice golf swing.

FIG. 6 shows a top front view of a golfer using the training aid [1] at an intermediate position of the takeaway portion of a practice golf swing. A set of two imaginary lines may form as the tensile member [3] is stretched. A band line [21] may be formed from the second attachment eye [11] in the foot band attachment component [10] to the first attachment eye on the grip bar [6] along the tensile member [3], and a second line, a lead arm line [22], may be formed from the shoulder to the distal terminus of the ulna or the pisiform carpal, where force may be directed from the shoulder into the hands which control the grip bar [6]. In this intermediate position of the takeaway portion of a practice golf swing, the band angle [23] formed between the band line [21] and the lead arm line [22] may be greater than 75 degrees.

Figure 7:
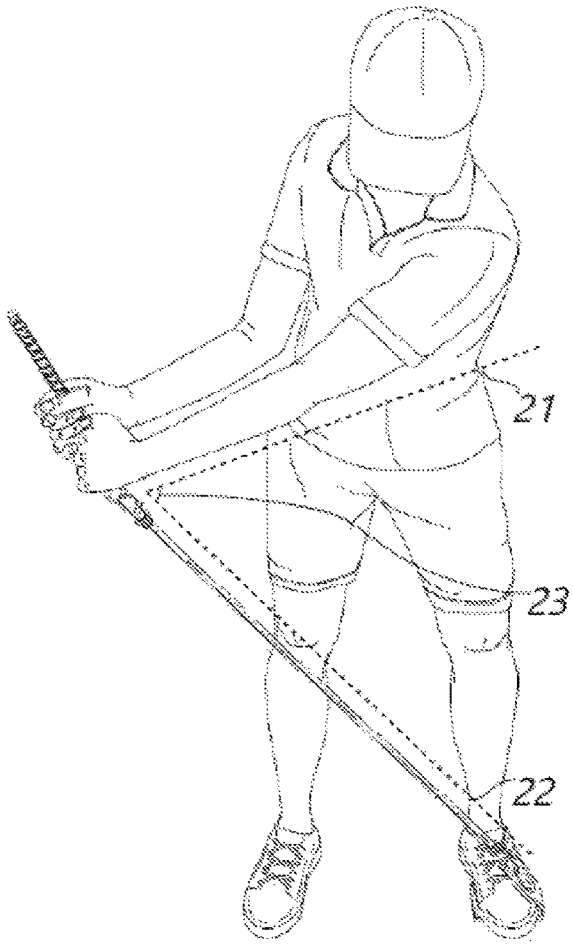
FIG. 7 shows a top front view of a golfer using the training aid at a further intermediate position of a takeaway portion of a practice golf swing close to a transition to a beginning of a backswing portion of a practice golf swing.

FIG. 7 shows a top front view of a golfer using the training aid [1] at another intermediate position of a takeaway portion of a practice golf swing close to a transition to a beginning of a backswing portion of a practice golf swing. In this intermediate position of a takeaway portion of a practice golf swing, the band angle formed between the band line [21] and the lead arm line [22] may be more acute than the band angle [23] formed between the two lines in the position depicted in FIG. 6.

Figure 8:
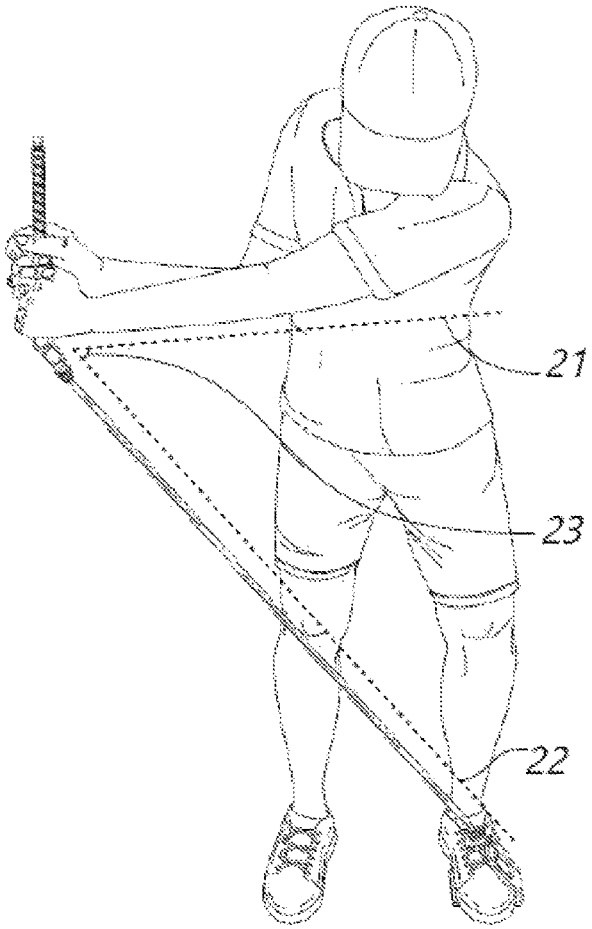
FIG. 8 shows a top front view of the golfer of FIG. 4 using the training aid at the end of a takeaway portion of a practice golf swing, transitioning to a beginning of a backswing portion of the practice golf swing.

FIG. 8 shows a top front view of the golfer of FIG. 4 using the training aid [1] at the end of a takeaway portion of a practice golf swing, transitioning to a beginning of a backswing portion of the practice golf swing. As the backswing or takeaway continues as shown in FIGS. 5-8, the band angle [23] formed between the band line [21] and the lead arm line [22] may narrow as the lead arm changes position. However, it is contemplated that the angle of the band line [21] may not be as dramatically affected. At this point in the practice golf swing, the band angle [23] formed between the band line [21] and the lead arm line [22] may preferably be forty-five degrees to match the angle of the eye arcuate portion [17] to fully capture the torque force and stabilize the bracket [10].

In FIGS. 2-8, the various positions of a golf swing including transitions from takeaway to a downswing path depict rotation of shoulders during the downswing. The invention aids the golfer with timing mechanics via resistance during the takeaway, which allows for a more compacted swing by preventing the arms from being overstretched and provides improved shoulder movement isolation during the takeaway and downswing transition portions of a golf swing.

According to a preferred method of use for a right-handed person, a user may first stand on the base plane [14] of the bracket [10] and adjust the tensile member [3] to allow approximately three feet from the bracket [10] to the top of the grip bar [6].

Then, with the left hand, the user may grip the grip bar [6], and with the right hand may grip and holds the grip bar [6] beneath the left hand. With the left hand, the user may push the club away from the body and allow the tensile member [3] to ease while rotating the grip bar [6] in a downswing motion. During the exercise, the tensile member [3] may allow for and facilitate tension during the takeaway process and allow for storing opposing potential energy, so that during the transition to the downswing the user's swing posture may properly react with timing via sensing muscular position and motion while maintaining the proper downswing form. Proper execution of the desired motion may hereby be experienced, repeated, and eventually retained as muscle memory.

Left-handed users may perform a symmetrically opposite set of motions as what is herein described and derive similar improvements in their golf swing technique.

Figure 9:
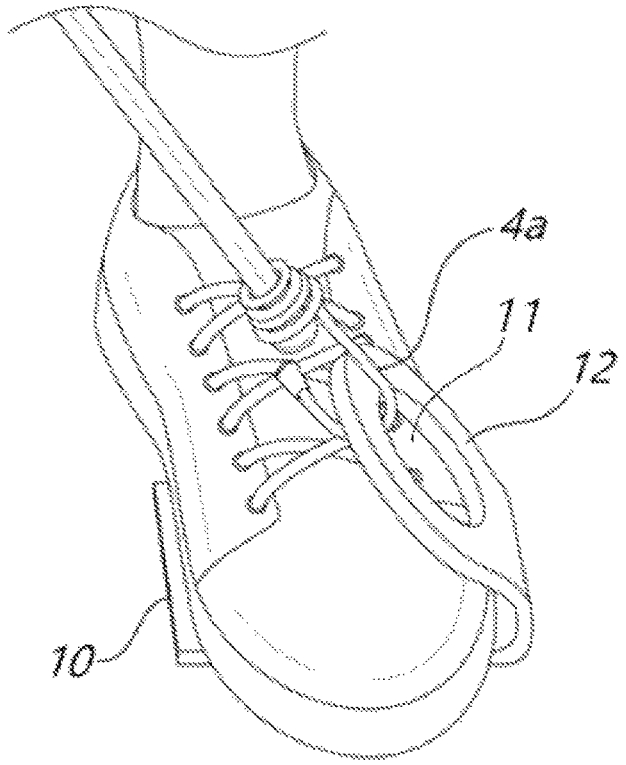
FIG. 9 shows a golfer's foot stepping on and securing a foot band attachment component in accordance with the invention.

FIG. 9 shows a golfer's foot stepping on and securing a bracket [10] in accordance with the invention. At least one from among the first attachment affordance [4*a*] and second attachment affordance [4*b*] of the tensile member [3] may be a hook, and the user may implement the hook to attach the tensile member [3] to the bracket [10]. In the embodiment shown in this figure, the hook may be made of formed wire.

When in use, the bracket [10] may be set against the golfer's foot such that the bracket [10] is secure and the tensile member [3] does not have slack. Preferably, the user may take a near parallel stance to the target. Since balance is required at each phase of the golf swing (address, takeaway, transition, downswing, and follow-through), positioning the foot outward greater than twenty degrees from near parallel may not be recommended. This may also cause the bracket [10] to lose its stability, and the training device to lose its effectiveness. As shown in FIGS. 5-8, the golfer's foot may be feathered outward approximately fifteen degrees, sometimes known as "feather in feet," as the feet may resemble the angled barbs that protrude from the shaft of a feather. The second attachment eye [11] may be rounded to accommodate swivel in feet. The second attachment eye

[11] may preferably be surrounded by a circumferential frame [12]. The second attachment eye [11] may include an interior arc portion [18] that provides a surface upon which an attachment affordance [4*a*, 4*b*] may attach. Once attached to the second attachment eye [11] via the interior arc portion [18], the attachment affordance [4*a*, 4*b*] may slidably move along the interior arc portion [18] along an arced trajectory, allowing for an accommodation for different stances amongst golfers of different heights, weights, arm lengths, and so forth.

For proper practice, it may be anticipated that the ball may be positioned close to a midpoint between the feet (the "center of the stance") to ensure consistent ball striking. An exception may be positioning the ball more proximal to the lead foot (forward in the stance) when using a driver or longer-shafted club, in order to achieve a higher launch angle at impact, as is known in the art of golf technique. Use of varied clubs may require varied placement of the ball, considering that heavily lofted clubs such as a 9-iron or pitching wedge may produce more consistent results with the ball placed in the center of the stance, and less lofted clubs such as a driver, wood, or long iron may produce more consistent results with the ball placed more forward in the stance. The training aid [1] may be useful for training the core and hips to rotate with the shoulders through the takeaway and downswing phases of the golf swing. As a driver has a different shaft length and club face angle, the impact zone may be moved forward. With irons 4-7 the ball may be positioned one ball-width to a half ball-width forwards toward the lead foot that steps on the base plane [14]. Keeping the base of golfer's foot planted, the golfer may only need to pivot their toes outwards about two inches from the base of the big toe or approximately twenty degrees. Older golfers tend to lose flexibility, and therefore may compensate by opening the lead foot slowly as a relief to the hips/hip joint, preset with the hips open and feet slightly open, and the lead shoulder pushing backward to initiate the backswing.

The ball of the lead foot may be positioned directly on the base plane [14] of the bracket [10]. However, when torque is building during the takeaway phase, slip resistance may not be guaranteed as the unit can become less stable, and a minimal amount of weight must be maintained on the base plane [14] to prevent destabilization. The outer edge of the user's foot may be nested in the arcuate portion [17] of the bracket [10].

Figure 10A:
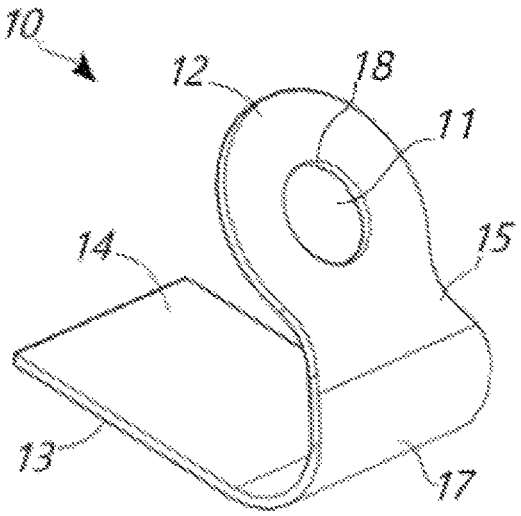
FIG. 10*a* shows an oblique, top front right view of a foot band attachment component in accordance with the invention.

FIG. 10*a* shows an oblique, top front right view of a bracket [10] in accordance with the invention wherein the bracket may be made of sheet metal. The bracket may include a first portion [13], a base plane [14] having a perimeter, and also may include an arcuate portion [17] which may connect a portion of the perimeter to a second portion [15] which may include a second attachment eye [11]. The second portion [15] also may include a circumferential frame [12] surrounding the second attachment eye [11], and the interior arc portion [18] along the second attachment eye [11]. The arcuate portion [17] may preferably create a forty-five-degree angle between the first [13] and second portions [15]. Preferred angles include forty to fifty degrees, hereinafter referred to as approximately forty-five degrees.

Figure 10B:
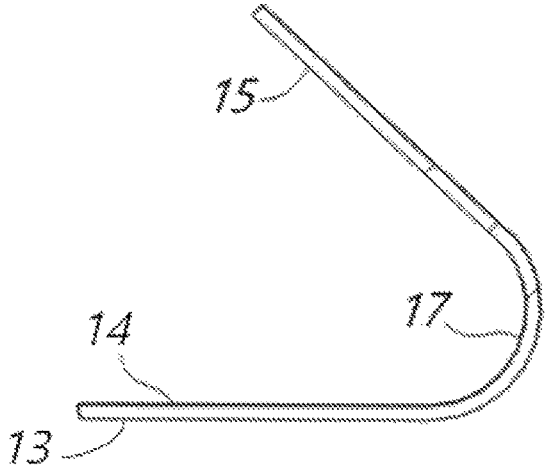
FIG. 10*b* shows a front view of the foot band attachment component of FIG. 10*a*.

FIG. 10*b* shows a front view of an embodiment of a bracket [10] of FIG. 10*a*. The bracket may have a first portion [13] having an edge, a second portion [15], wherein the circumferential frame [12] is edge-on in this view, and an arcuate portion [17] connecting an edge of the first portion [13] to the second portion [15].

Figure 11A:
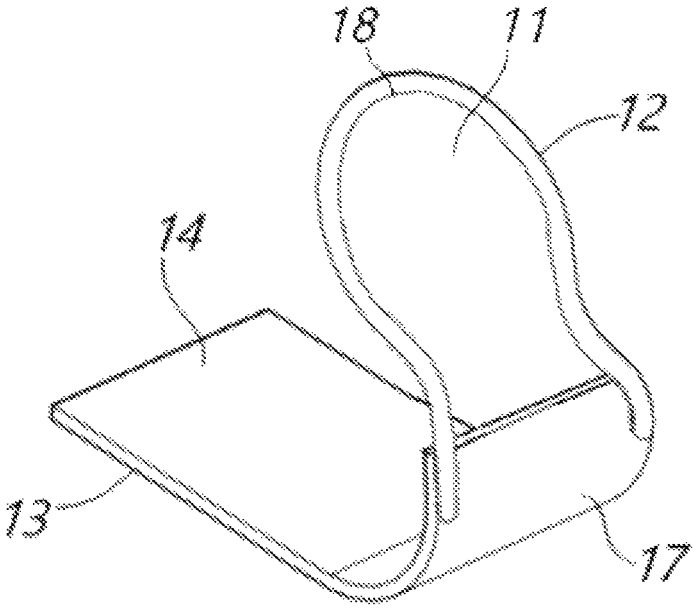
FIG. 11*a* shows an oblique, top front right view of an alternative embodiment of a foot band attachment component in accordance with the invention.

FIG. 11*a* shows an oblique, top front right view of an alternative embodiment of bracket [10] in accordance with the invention. In this embodiment, the first portion [13] may be made of sheet metal and may define a base plane [14], which may connect to an arcuate portion [17]. The second portion [15] may be made of formed metal wire and may be attached to the arcuate portion [17].

Figure 11B:
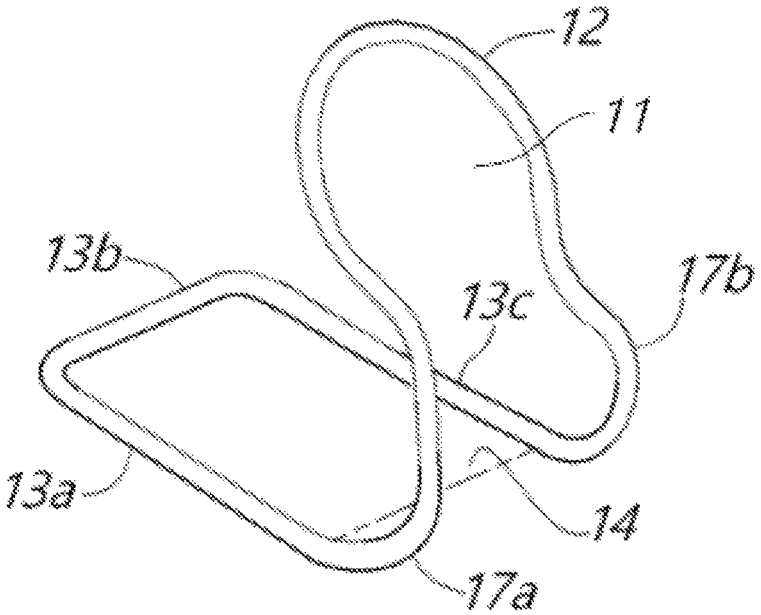
FIG. 11*b* shows an oblique, top front right view of another alternative embodiment of a foot band attachment component in accordance with the invention.

FIG. 11*b* shows an oblique, top front right view of another alternative embodiment of a bracket [10] in accordance with the invention which may be entirely made of formed metal wire. In this embodiment, the base plane [14] may have a perimeter at least partially defined by three lengths of substantially straight runs of formed metal wire defining three sides of a quadrilateral. In this embodiment, the three sides of the quadrilateral may make up the perimeter of the first portion [13]. The two parallel legs, [13*a*] and [13*c*], of the quadrilateral may continue as first and second arcuate arms[17*a*] and [17*b*], respectively, to a second portion which may include a second attachment eye [11].

Figure 12:
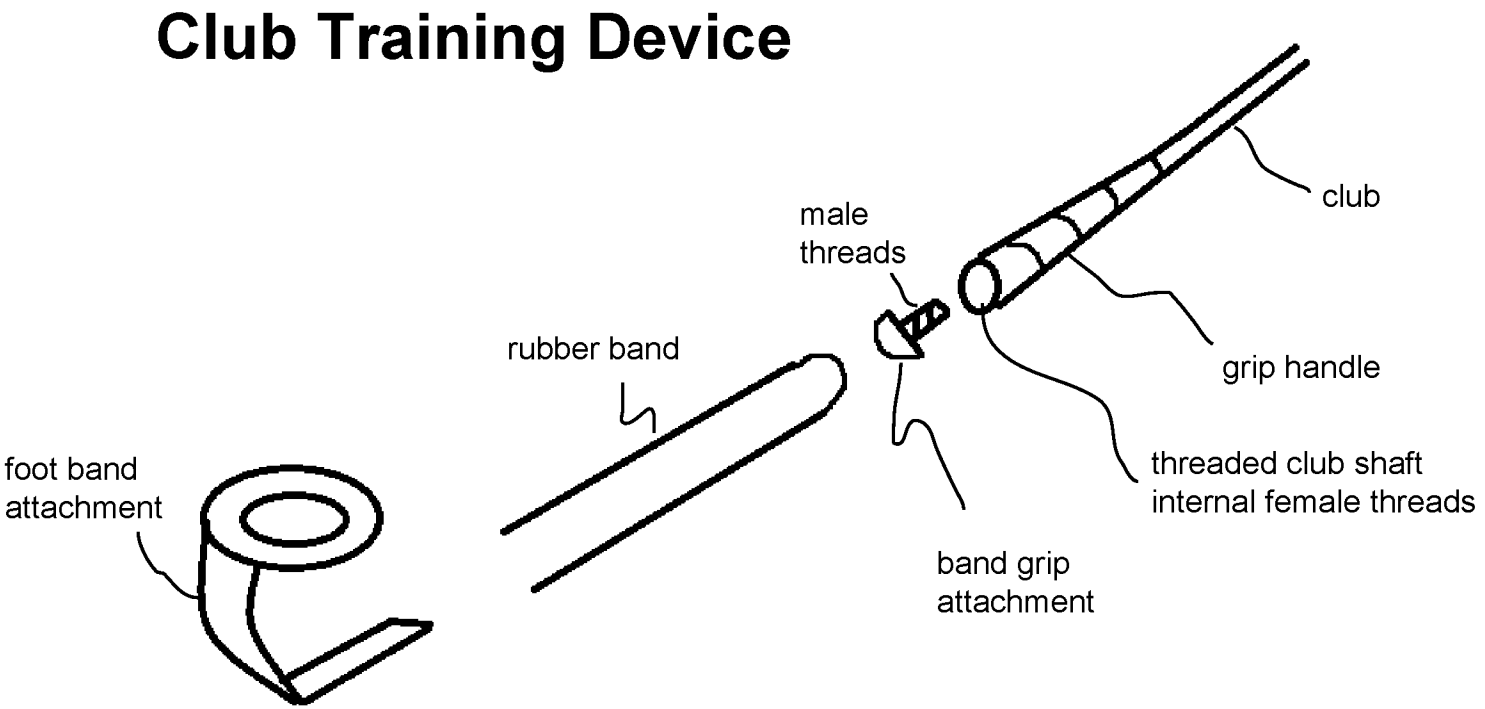
FIG. 12 shows an exploded view of an embodiment of the invention, including the foot band attachment component, extendable tensile member, and grip bar.

FIG. 12 shows an exploded view of an embodiment of a golf swing training aid [1]. In this embodiment, the grip handle [6] may be attached to a first attachment eye [8]. The tensile member [3] is fed through the first attachment eye [8] and doubled back upon itself such that both ends [5*a*, 5*b*] of the tensile member [3] may attach to the bracket [10] at the secondary attachment eye [11] on its interior arc portion [18].

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently, and in summary, although many exemplary embodiments are described above, it will be appreciated that the invention is intended to cover all modifications and equivalents within the scope of the following claims.

What is claimed is:

1. A golf swing training aid, comprising:

a) a substantially cylindrical grip bar with a first larger end tapering to a second smaller end and a first attachment eye at said first end;

b) an extendable tensile member having first and second attachment affordances respectively at its first and second ends; and c) a toot band attachment component comprising:

a second attachment eye;

an interior arc portion whereby an attachment alibidance may slidably move along an arced trajectory; and a circumferential frame;

a base plane having a perimeter; and at least one arcuate portion connecting said perimeter to said second attachment eye.

2. The golf swing training aid of claim 1, wherein said grip bar comprises at least a portion of a golf club.

3. The golf swing training aid of claim 1, wherein said grip bar comprises a threaded aperture and said first attachment eye comprises a threaded bolt member received within said threaded aperture.

4. The golf swing training aid of claim 1, wherein said arcuate portion is approximately forty-five degrees.

5. The golf swing training aid of claim 1, wherein said foot band attachment comprises a forward direction towards a target; said arcuate portion being directed away from the forward direction.

6. The golf swing training aid of claim 1, wherein one from among said first and second attachment affordances of said extendable tensile member is a hook.

7. The golf swing training aid of claim 6, wherein said hook is made of formed wire.

8. The golf swing (raining aid of claim 1, wherein said extendable tensile member comprises bungee cord.

9. The golf swing training aid of claim 1, wherein said first, and second attachment affordances of said extendable tensile member are coupled to said first attachment eye, and said extendable tensile member passes through said second attachment eye.

10. The golf swing training aid of claim 1, Wherein said first and second attachment affordances of said extendable tensile member are coupled to said second attachment eye, and said extendable tensile member passes through said first attachment eye.

11. A golf swing training aid kit, comprising:

a) a grip bar with a first larger end tapering to a second smaller end and a first attachment eye at said first end;

b) an extendable tensile member having first and second attachment affordances respectively at its first and second ends; and c) a bracket further comprising:

a first portion having an edge and a perimeter;

a second portion further comprising:

a second attachment eye;

a circumferential frame surrounding the second attachment eye; and an interior arc portion de-fining a boundary of the second attachment eye whereby said attachment affordance may slidably move along an arced trajectory; and an arcuate portion connecting said edge of said first planar member to said second portion.

12. The golf swing training aid kit of claim 11, wherein said grip bar comprises at least a portion of a golf club.

13. The golf swing training aid kit of claim 11, wherein said grip bar comprises a threaded aperture and said first attachment eye comprises a threaded bolt member received within said threaded aperture.

14. The golf swing training aid kit of claim 11, wherein said bracket comprises an angle of approximately forty-five degrees as between the second portion and the first portion.

15. The golf swing training aid kit of claim 11, wherein said second portion of said bracket comprises formed metal wire.

16. The golf swing training aid of kit claim 11, wherein one from among said first and second attachment affordances of said extendable tensile member is a hook.

17. The golf swing training aid kit of claim 16, wherein said hook is made of formed wire.

18. The golf swing training aid kit of claim 11, wherein said extendable tensile member comprises bungee cord.

* * * * *